US010537210B1

(12) United States Patent
Lee

(10) Patent No.: US 10,537,210 B1
(45) Date of Patent: Jan. 21, 2020

(54) WHIRLPOOL BATH WITH DESCALING FUNCTION

(71) Applicant: Changju Lee, Namyangju-si (KR)

(72) Inventor: Changju Lee, Namyangju-si (KR)

( * ) Notice: Subject to any disclaimer, the term of this patent is extended or adjusted under 35 U.S.C. 154(b) by 0 days.

(21) Appl. No.: 16/046,341

(22) Filed: Jul. 26, 2018

(51) Int. Cl.

| | |
|---|---|
| ***A47K 3/10*** | (2006.01) |
| ***B08B 9/032*** | (2006.01) |
| ***A61H 33/00*** | (2006.01) |
| ***A61H 33/02*** | (2006.01) |

(52) U.S. Cl.
CPC ..... *A47K 3/10* (2013.01); *A61H 33/0087* (2013.01); *A61H 33/027* (2013.01); *A61H 33/028* (2013.01); *B08B 9/0328* (2013.01); *A61H 2033/0037* (2013.01); *A61H 2033/021* (2013.01)

(58) Field of Classification Search
CPC ..... A61H 33/0087; A61H 33/027; A61H 33/028; A47K 3/10
USPC ..... 4/541.1, 541.5
See application file for complete search history.

(56) References Cited

U.S. PATENT DOCUMENTS 5,032,292 A * 7/1991 Conrad ..... A61H 33/0087 210/136

FOREIGN PATENT DOCUMENTS

| | | | |
|---|---|---|---|
| JP | H08-182717 | A1 | 7/1996 |
| JP | H11-239770 | A1 | 9/1999 |
| JP | 2000-240598 | A1 | 9/2000 |
| JP | 2010-274224 | A1 | 12/2010 |
| KR | 20-2009-0000774 | U | 1/2009 |
| KR | 10-2011-0099978 | A | 9/2011 |
| KR | 10-1541875 | B1 | 8/2015 |
| KR | 10-2017-0116443 | A1 | 10/2017 |
| KR | 20-2017-0003421 | U | 10/2017 |

* cited by examiner

*Primary Examiner* — Christine J Skubinna
(74) *Attorney, Agent, or Firm* — Hauptman Ham, LLP

(57) ABSTRACT

A whirlpool bath with descaling function is provided. The whirlpool bath 1 comprises a bathtub body 10 including a bathtub 11, suction port 20 sucking the water contained in the bathtub 11, first jet nozzles 30 jetting bubble water into the bathtub 11, a circulation pipe 40 including a water supply pipe 41 and a return pipe 42, a pump 50 installed in the circulation pipe 40, a bypass pipe 60 branched from the water supply pipe 41 and connected to the return pipe 42 to directly return the water in the water supply pipe 41 to the pump, and a second jet nozzle 70 mixing air with water passing through the bypass pipe 60 to generate and jet bubble water. The scale of the circulation pipe 40, the pump 50 and the bypass pipe 60 is removed by bubble water generated by the second jet nozzle 70.

3 Claims, 5 Drawing Sheets

Prior art

WHIRLPOOL BATH WITH DESCALING FUNCTION

TECHNICAL FIELD

The present invention relates to a whirlpool bath, and more particularly, to a whirlpool bath capable of inhibiting the generation of scale in pipes through which water circulates and removing scale generated in the pipes.

BACKGROUND ART

As widely known, a whirlpool bath is a bath having a function of jetting water or bubble water at a high pressure into a bathtub.

As the prior art about the whirlpool bath, there is, for example, a whirlpool bath of FIG. 6 disclosed in Korean Utility Patent Laid-Open No 20-2009-0000774.

As illustrated in FIG. 6, the prior whirlpool bath 100 includes a bathtub body 110 in which a bathtub 111 is formed, suction port 120 sucking the water in the bathtub 111, jet nozzles 130 jetting bubble water into the bathtub 111, a circulation pipe 140 having a water supply pipe 141 and a return pipe 142, and a pump 150 installed in the circulation pipe 140.

The water supply pipe 141 is connected to the jet nozzles 130 and supplies water to the jet nozzles 130. The return pipe 142 is connected to the suction port 120 and returns water in the bathtub 111 to the pump 150. The pump 150 provides a water pressure for sucking the water in the bathtub 111 through the suction port 120 and for jetting bubble water through the jet nozzles 130.

Since the whirlpool bath uses a certain amount of water repeatedly and the water is circulated in the circulation pipe 140, dirt separated from the human body and components contained in tap water can be adhered to the inner surface of the circulation pipe 140, as a result, scale can be easily generated on the inner surface of the circulation pipe 140.

The scale of the circulation pipe 140 partially falls off into the water during the use of the whirlpool bath. The detached scale not only makes the user feel dirty, but also is not good for hygiene, thereby acts as a factor to be reluctant to use the whirlpool bath. For this reason, it is necessary to hygienically manage the piping of whirlpool bath.

One of the typical pipe sanitary management methods is to periodically clean the scale attached to the pipe using a chemical detergent with strong cleaning effect.

As an additional method of hygienic management of the whirlpool bath, there are a method of suppressing the propagation of germs by applying the ozone sterilizing apparatus disclosed in Korean Patent Laid-Open No. 10-2011-0099978 and a method of preventing water from remaining in the whirlpool bath after use disclosed in Korean Patent No. 10-1541875.

However, the washing method of the scale by the detergent has a problem that the washing operation is very difficult. Also, the method of ozone disinfection and the method of removing residual water are merely auxiliary methods and are not a fundamental way to hygienically manage the whirlpool bath.

SUMMARY OF THE INVENTION

The object of the present invention is to provide a whirlpool bath with descaling function, capable of suppressing generation of scale in pipes circulating water in a whirlpool bath and eliminating the scale already generated in the pipes.

A whirlpool bath according to the present invention comprises a bathtub body, suction port, first jet nozzles, a circulation pipe, a pump, a bypass pipe and a second jet nozzle.

Said bathtub body includes bathtub.

Said suction port sucks the water contained in said bathtub.

Said first jet nozzles jet bubble water into said bathtub.

Said circulation pipe includes a water supply pipe and a return pipe.

Said water supply pipe is connected to said first jet nozzles. Said water supply pipe supplies water to said first jet nozzles. Said return pipe is connected to said suction port. Said return pipe returns water in said bathtub to said pump.

Said pump is installed in said circulation pipe. Said pump provides a water pressure for sucking the water in said bathtub through said suction port and for jetting bubble water through said first jet nozzles.

Said bypass pipe is branched from said water supply pipe. Said bypass pipe is connected to said return pipe. Said bypass pipe directly returns the water introduced into said water supply pipe to said pump through said return pipe.

Said second jet nozzle is installed in said bypass pipe. Said second jet nozzle mixes air with water passing through said bypass pipe to generate and jet bubble water.

The scale generated in said circulation pipe, said pump, and said bypass pipe is removed (descaled) by bubble water generated by said second jet nozzle.

Said second jet nozzle may include a bypass pipe connect part, a mixing part, a nozzle part, a Venturi part and an intake part.

Said bypass pipe connect part is connected to said bypass pipe. Said bypass pipe connect part receives water from said bypass pipe.

Said mixing part is formed in the downstream of said bypass pipe connect part, wherein water and air are mixed to generate bubble water.

Said nozzle part is connected to said mixing part. Said nozzle part has a nozzle for jetting bubble water into said the return pipe or said bypass pipe.

Said Venturi part is formed between said bypass pipe connect part and said mixing part.

Said intake part is formed in communication with said mixing part. Said intake part supplies external air to said mixing part by a negative pressure generated by the action of said Venturi part.

Said second jet nozzle may comprise a check valve installed in said intake part for blocking water from flowing backward through said intake part.

According to the whirlpool bath of the present invention, water flowing into said bypass pipe from said water supply pipe is returned to said pump through said return pipe without passing through said bathtub, and said second jet nozzle generates bubble water by mixing air with water passing through said bypass pipe, and the bubble water jetted by said second jet nozzle passes through said circulation pipe, said pump, and said bypass pipe by jetting the generated bubble water into said return pipe or said bypass pipe, thereby preventing scale from being generated in the pipes and removing the generated scale.

DETAILED DESCRIPTION

Hereinafter, a whirlpool bath according to the present invention will be described with reference to the accompanying drawings. A detailed example given below just exemplarily describe the present invention and does not restrict the present invention.

Figure 1:
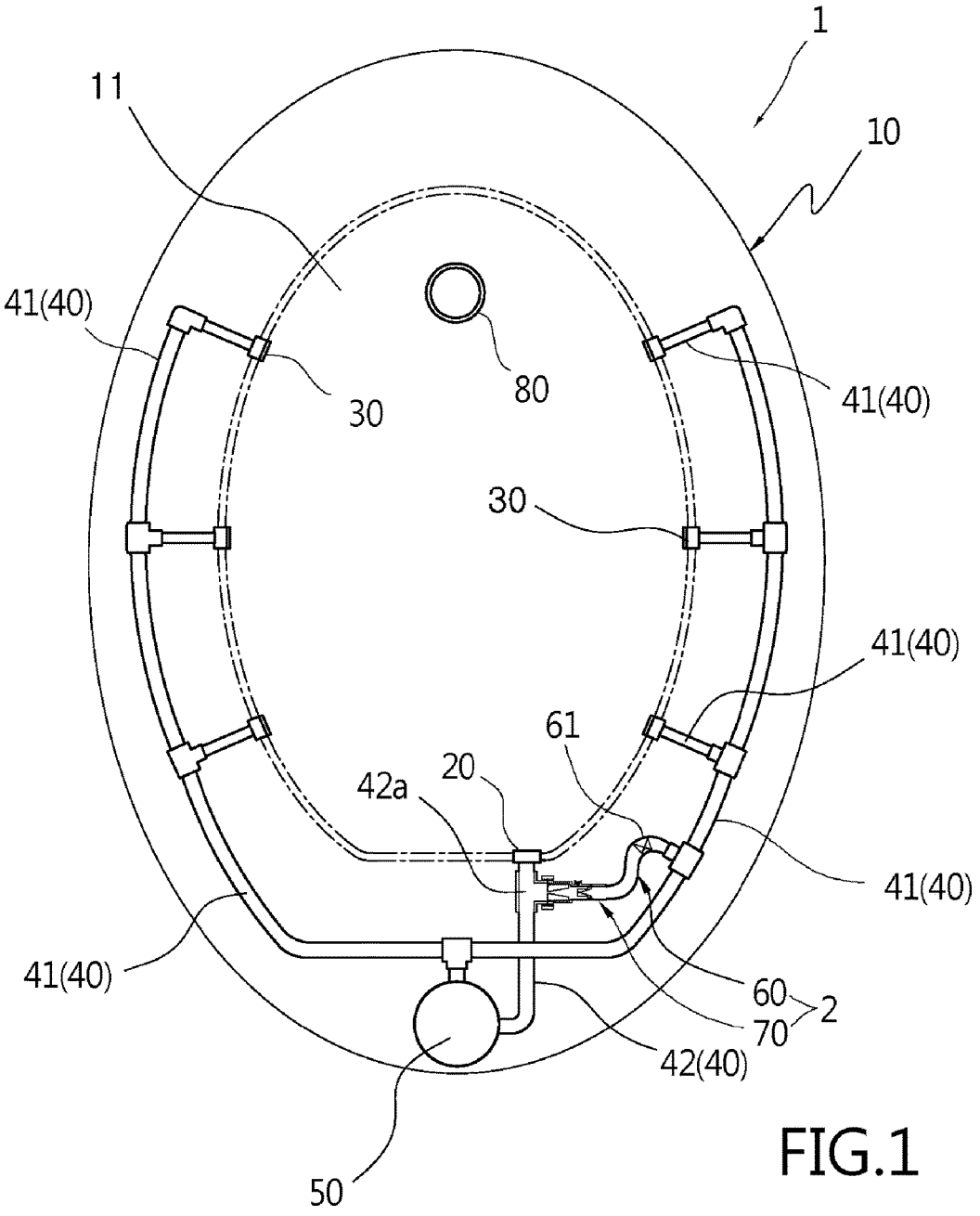
FIG. 1 is a schematic diagram of an exemplary whirlpool bath according to the present invention.

As illustrated in FIG. 1, the whirlpool bath 1 according to the present invention comprises a bathtub body 10, suction port 20, first jet nozzles 30, a circulation pipe 40 and a pump 50, like the prior art whirlpool bath.

The bathtub body 10 includes a bathtub 11.

The suction port 20 sucks the water contained in the bathtub 11.

The first jet nozzles 30 jet bubble water into the bathtub 11.

The circulation pipe 40 includes a water supply pipe 41 and a return pipe 42.

The water supply pipe 41 is connected to the first jet nozzles 30. The water supply pipe 41 supplies water to the first jet nozzles 30. The return pipe 42 is connected to the suction port 20. The return pipe 42 returns water in the bathtub 11 to the pump 50.

The pump 50 is installed in the circulation pipe 40. The pump 50 provides a water pressure for sucking the water in the bathtub 11 through the suction port 20 and for jetting bubble water through the first jet nozzles 30.

In the whirlpool bath 1 of the present invention, the water contained in the bathtub 11 is sucked into the suction port 20 and sends to the pump 50 through the return pipe 42, and the water pumped by the pump 50 is again jetted into the bathtub 11 through the first jet nozzles 30 formed at ends of the water supply pipe 41 via the water supply pipe 41. In the first jet nozzles 30, water supplied from the water supply pipe 41 and air from the outside are mixed to generate bubble water, and the bubble water is jetted into the bathtub 11. Although it is preferable to jet the bubble water through the first jet nozzles 30, the case where water is jetted is not excluded.

According to a feature of the present invention, the whirlpool bath 1 includes a bypass pipe 60 and a second jet nozzle 70. That is, the whirlpool bath 1 of the present invention comprises a descaling device 2 including the bypass pipe 60 and the second jet nozzle 70.

The bypass pipe 60 is a pipe branched from the water supply pipe 41 and it is connected to the return pipe 42. The water flowing into the bypass pipe 60 from the water supply pipe 41 is returned to the pump 50 through the return pipe 42 without passing through the bathtub 11.

The second jet nozzle 70 is a nozzle for generating bubble water by mixing air with water passing through the bypass pipe 60. The second jet nozzle 70 is installed in the bypass pipe. The second jet nozzle 70 jets the bubble water to the bypass pipe 60 or the return pipe 42.

The bubble water generated by the second jet nozzle 70 suppresses generation of scale in the return pipe 42, the pump 50, the water supply pipe 41 and the bypass pipe 60 involved in the circulation of the water and piped to the downstream of the second jet nozzle 70, and the bubble water removes the scale already generated in the pipes, by the known cleaning action of the bubble water.

Namely, since the bypass pipe 60 branched from the water supply pipe 41 is piped to the return pipe 42 and the second jet nozzle 70 is provided to the bypass pipe 60, high pressure bubble water is jetted into the return pipe 42. The bubble water jetted to the return pipe 42 passes through the return pipe 42, the pump 50, the water supply pipe 41 and the bypass pipe 60 in order, thereby the scale generated in the pipes is cleaned and scale formation in the pipes is suppressed.

The first jet nozzles 30 are not particularly limited as long as they can mix the air and water supplied through the water supply pipe 41 to generate bubble water and jet the bubble water into the bathtub 11.

Figure 2:
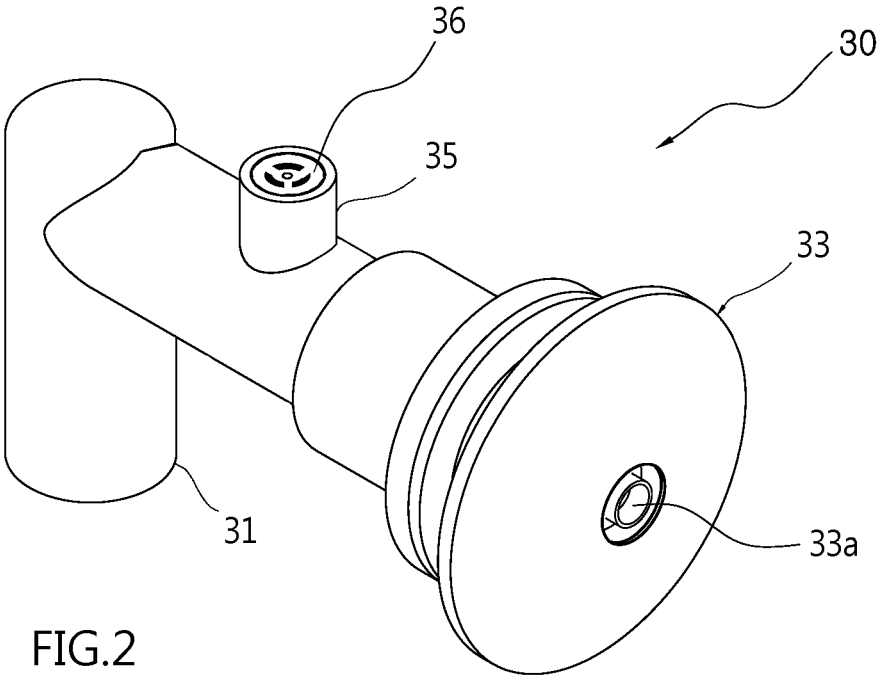
FIG. 2 is a schematic perspective view of an exemplary first jet nozzle applied to the whirlpool bath of the present invention.
Figure 3:
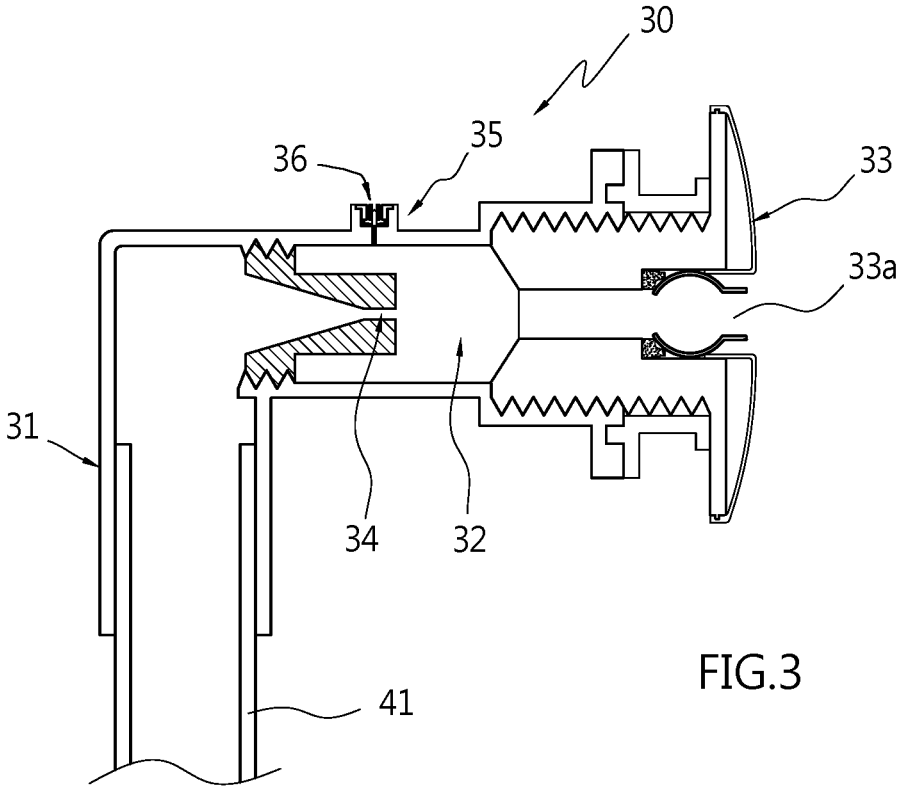
FIG. 3 is a section view of an exemplary first jet nozzle applied to the whirlpool bath of the present invention.

As illustrated in FIG. 2 and FIG. 3, each of the first jet nozzles 30 may comprise a water supply pipe connect part 31, a mixing part 32, a nozzle part 33, a Venturi part 34 and an intake part 35.

The water supply pipe connect part 31 is connected to the water supply pipe 41. The water supply pipe connect part 31 receives water from the water supply pipe 41.

The mixing part 32 is formed in the downstream of the water supply pipe connect part 31, wherein water and air are mixed to generate bubble water.

The nozzle part 33 is connected to the mixing part 32. The nozzle part 33 has a nozzle 33*a* for jetting bubble water into the bathtub 11.

The Venturi part 34 is formed between the water supply pipe connect part 31 and the mixing part 32, and has a narrow diameter.

The intake part 35 is formed in communication with the mixing part 32. The intake part 35 supplies external air to the mixing part 32 by a negative pressure generated by the action of the Venturi part 34.

When the water supplied from the water supply pipe 41 flows from the water supply pipe connect part 31 to the mixing part 32 via the Venturi part 34, a negative pressure is generated by the flow velocity increase in the Venturi part 34. Thereby, outside air is introduced into the mixing part 32 through the intake part 35. In the mixing part 32, bubble water mixed with water and air is generated, and the bubble water is jetted into the bathtub 11 though a nozzle 33*a* of the nozzle part 33.

A check valve 36 may be provided in the intake part 35 to prevent water from flowing backward to the outside through the intake part 35. The check valve 36 applicable to the first jet nozzle 30 is not limited as long as it is a valve that can prevent water from flowing backward through the intake part 35. For example, the check valve 36 such as a thin film type check valve 76 applied to the second jet nozzle 70 described later can be applied.

The second jet nozzle 70 is substantially the same as the first jet nozzle 30 in that air is mixed with water to generate and jet bubble water.

As illustrated in FIG. 1, the first jet nozzles 30 are provided at the ends of the water supply pipe 41 so as to jet the bubble water into the bathtub 11. In contrast, the second jet nozzle 70 is provided to the bypass pipe 60, and the bubble water of the second jet nozzle 70 is supplied to the return pipe 42, and the bubble water passes the return pipe 42, the pump 50, the water supply pipe 41 and the bypass pipe 60, as a result, scale formation in the pipes is suppressed and the scale already formed in the pipes is cleaned and removed.

The second jet nozzle 70 is not particularly limited as long as it is a structure capable of mixing air with water passing through the bypass pipe 60 to generate bubble water and jet it.

Since the scale removing action of the bubble water jetted by the second jet nozzle 70 occurs at a position downstream of the point where the second jet nozzle 70 is installed, preferably, the bypass pipe 60 is connected to the return pipe 42 at a location adjacent to the suction port 20 as possible.

The installation position of the second jet nozzle 70 in the bypass pipe 60 is not particularly limited as long as it can supply the bubble water to the return pipe 42.

Figure 5:
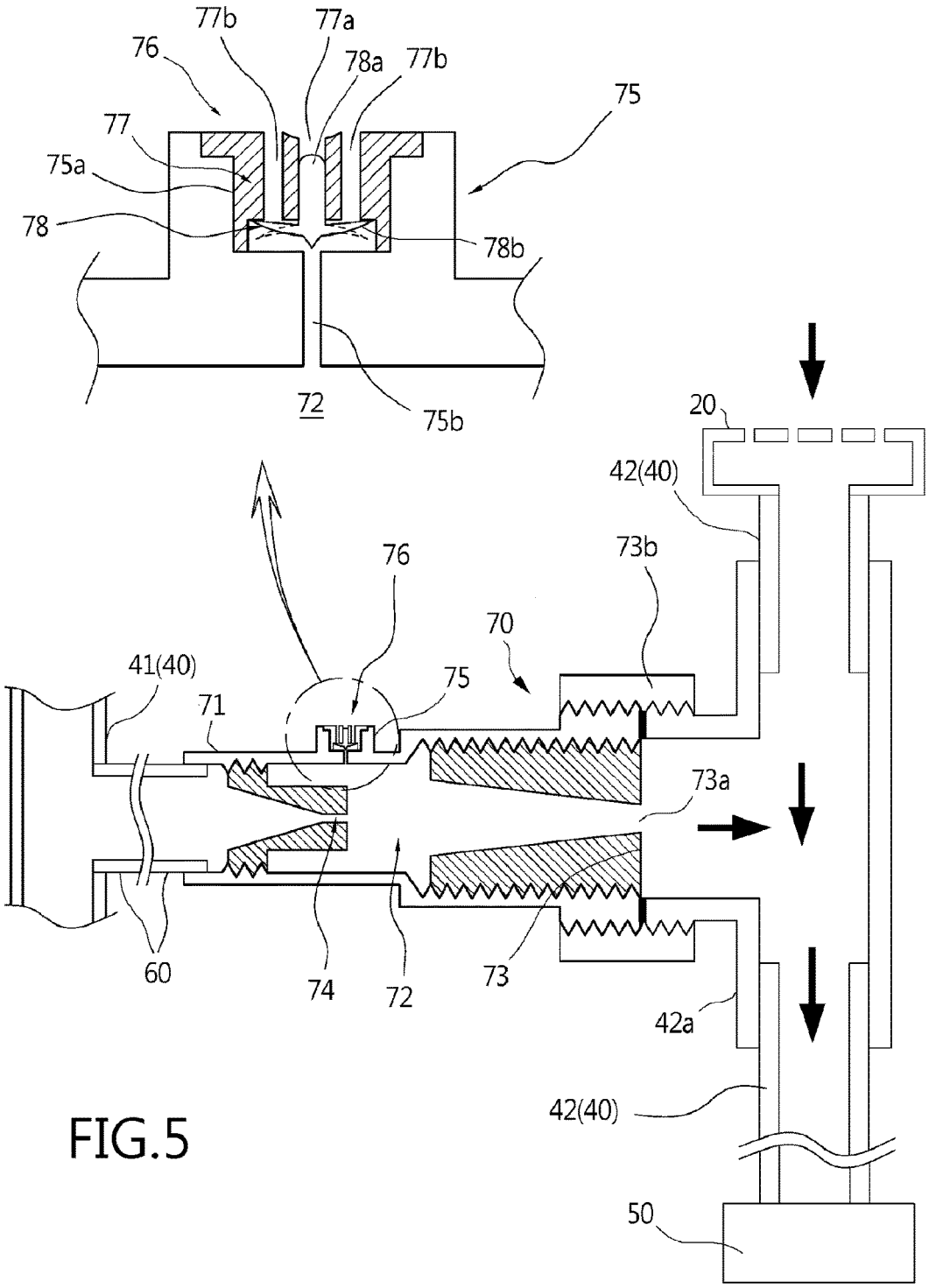
FIG. 5 is a section view of an exemplary second jet nozzle applied to the whirlpool bath of the present invention.
Figure 6:
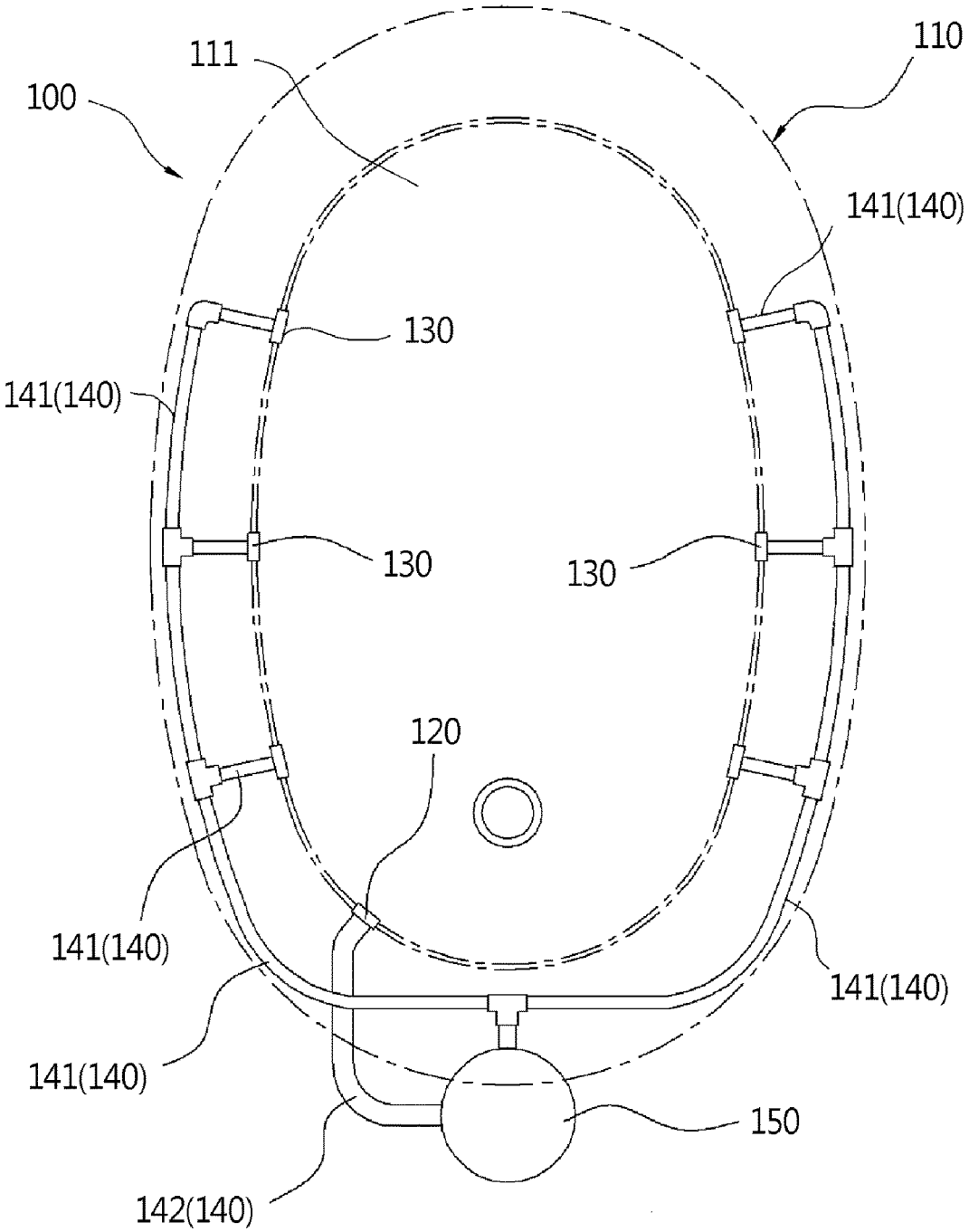
FIG. 6 is a schematic diagram of prior art whirlpool bath.

In the embodiment illustrated in FIG. 1 and FIG. 5, the bypass pipe 60 is connected to the return pipe 42 adjacent to the suction port 20 and the second jet nozzle 70 is disposed at the downstream end of the bypass pipe 60, thereby bubble water is directly jetted to the return pipe 42. As another example, the second jet nozzle 70 may be provided at the intermediate point of the bypass pipe 60, then the bubble water is jetted into the bypass pipe 60 and the jetted bubble water flows through the return pipe 42 via the bypass pipe 60.

Figure 4:
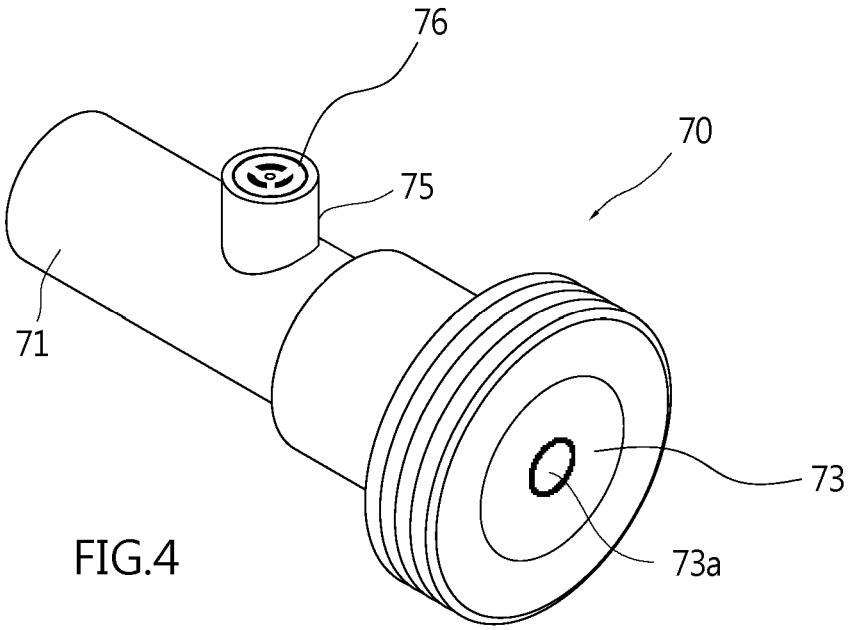
FIG. 4 is a schematic perspective view of an exemplary second jet nozzle applied to the whirlpool bath of the present invention.

As illustrated in FIG. 4 and FIG. 5, the second jet nozzle 70 may comprise a bypass pipe connect part 71, a mixing part 72, a nozzle part 73, a Venturi part 74 and an intake part 75.

The bypass pipe connect part 71 is connected to the bypass pipe 60. The bypass pipe connect part 71 receives water from the bypass pipe 60.

The mixing part 72 is formed in the downstream of the bypass pipe connect part 71, wherein water and air are mixed to generate bubble water.

The nozzle part 73 is connected to the mixing part 72. The nozzle part 73 has a nozzle 73*a* for jetting bubble water into the return pipe 42 or the bypass pipe 60.

The Venturi part 74 is formed between the bypass pipe connect part 71 and the mixing part 72, and it has a narrow diameter.

The intake part 75 is formed in communication with the mixing part 72. The intake part 75 supplies external air to the mixing part 72 by a negative pressure generated by the action of the Venturi part 74.

In the embodiment illustrated in FIG. 5, for example, a T-shaped member 42*a* is applied in the return pipe 42, and the T-shaped member 42*a* and the nozzle part 73 are connected by a known connecting member such as a union joint 73*b*.

According to the second jet nozzle 70, when the water supplied from the water supply pipe 41 flows from the bypass pipe connect part 71 to the mixing part 72 via the Venturi part 74, a negative pressure is generated by the flow velocity increase in the Venturi part 74 s, thereby, outside air is introduced into the mixing part 72 through the intake part 75. In the mixing part 72, bubble water mixed with water and air is generated, and the bubble water is jetted into the return pipe 42 or the bypass pipe 60.

The water jetted into the return pipe 42 by the second jet nozzle 70 passes the return pipe 42, the pump 50, the water supply pipe 41 and the bypass pipe 60 in order, thereby the scale generated in the pipes is cleaned and scale formation in the pipes is suppressed.

A check valve 76 may be provided in the intake part 75 to prevent water from flowing backward to the outside through the intake part 75.

As illustrated in FIG. 5, the intake part 75 may be formed with a valve mounting groove 75*a* communicating with the mixing part 72 through an intake path 75*b*.

A check valve 76 may include a valve chamber 77 and a thin plate valve 78. The check valve 76 may be mounted on the valve mounting groove 75*a*.

The valve chamber 77 is tightly fitted to the valve mounting groove 75*a*. The valve chamber 77 includes an insert hole 77*a* and air paths 77*b*. The insert hole 77*a* is formed at the center and the air paths 77*b* are formed around the insert hole 77*a*. The air paths 77*b* allow the mixing part 72 to communicate with the outside via the intake passage 75*b*.

The thin plate valve 78 may include an insert rod part 78*a* and a flexible thin plate part 78*b*. The insert rod part 78*a* is inserted and fixed to the insert hole 77*a*. The flexible thin plate part 78*b* is formed at the lower end of the insert rod part 78*a* to selectively cover the air path 77*b*.

According to the action of the check valve 76 as described above, the inflow of air into the mixing part 72 from the outside through the air path 77*b* is allowed by the fact that the thin plate part 78*b* of the thin plate valve 78 is displaced downward and that the air path 77*b* is opened (dotted line in FIG. 5), whereas the backward flow of water from the mixing part 72 through the air path 77*b* is blocked by the close contact of the thin plate part 78*b* and the closure of the air path 77*b* (solid line in FIG. 5).

Therefore, the air is supplied to the mixing part 72 through the check valve 76 by the negative pressure generated in the Venturi part 74, but the water in the mixing part 72 cannot flow backward to the outside due to the action of the check valve 76.

As illustrated in FIG. 1, the bypass pipe 60 may be provided with an on-off valve 61 which can be operated by a control panel (not shown). By selectively opening and closing the flow of water through the bypass pipe 60 by the on-off valve 61, the operation of the descaling function can be selectively stopped when it is desired not to use it.

Reference numeral 80 in FIG. 1 is a drain port for terminating the use of the whirlpool bath 1 and draining water.

What is claimed is:

1. A whirlpool bath with descaling function, comprising:

a bathtub body 10 including a bathtub 11;

a suction port 20 sucking the water contained in said bathtub 11;

first jet nozzles 30 jetting bubble water into said bathtub 11;

a circulation pipe 40 including a water supply pipe and a return pipe 42, wherein said water supply pipe 41 is connected to said first jet nozzles 30 and supplies water to said first jet nozzles 30, and said return pipe 42 is connected to said suction port 20 and returns water in said bathtub 11;

a pump 50 installed in said circulation pipe 40 to provide a water pressure for sucking the water in said bathtub 11 through said suction port 20 and for jetting bubble water through said first jet nozzles 30;

a bypass pipe 60 branched from said water supply pipe 41 and connected to said return pipe 42 to directly return the water introduced into said water supply pipe 41 to said pump 50 through said return pipe 42; and a second jet nozzle 70 installed in said bypass pipe 60 and mixing air with water passing through said bypass pipe 60 to generate and jet bubble water, wherein the scale of said circulation pipe 40, said pump 50 and said bypass pipe 60 is removed by bubble water generated by said second jet nozzle 70.

2. The whirlpool bath with descaling function according to claim 1, wherein said second jet nozzle 70 comprise:

a bypass pipe connect part 71 connected to said bypass pipe 60 and receiving water from said bypass pipe 60;

a mixing part 72 formed in the downstream of said bypass pipe connect part 71, wherein water and air are mixed to generate bubble water;

a nozzle part 73 connected to said mixing part 72 and having a nozzle 73*a* for jetting bubble water into said return pipe 42 or said bypass pipe 60;

a Venturi part 74 formed between said bypass pipe connect part 71 and said mixing part 72; and an intake part 75 formed in communication with said mixing part 72 and supplying external air to said mixing part 72 by a negative pressure generated by the action of said Venturi part 74.

3. The whirlpool bath with descaling function according to claim 2, wherein said second jet nozzle 70 comprises a check valve 76 installed in said intake part 75 for blocking water from flowing backward through said intake part 75.

* * * * *